US005521589A

United States Patent [19]

Mondrosch et al.

[11] Patent Number: 5,521,589

[45] Date of Patent: May 28, 1996

[54] METHOD AND APPARATUS FOR RECEIVING AND SELECTIVELY ANNOUNCING TIME-ACTIVATED MESSAGES

[75] Inventors: Nancy E. Mondrosch, Boynton Beach; Gregory L. Cannon, Delray Beach, both of Fla.

[73] Assignee: Motorola, Inc., Schaumburg, Ill.

[21] Appl. No.: 319,360

[22] Filed: Oct. 6, 1994

Related U.S. Application Data

[63] Continuation of Ser. No. 963,883, Oct. 19, 1992, abandoned.

[51] Int. Cl.[6] ..... G08B 5/22

[52] U.S. Cl. ..... 340/825.36; 340/825.44; 364/569; 364/705.05

[58] Field of Search ..... 340/825.36, 825.44, 340/539; 368/251; 379/57; 364/569, 705.05

[56] References Cited

U.S. PATENT DOCUMENTS

| | | | |
|---|---|---|---|
| 4,715,010 | 12/1987 | Inoue et al. | 364/705 |
| 4,872,005 | 10/1989 | DeLuca et al. | 340/825.44 |
| 4,972,457 | 11/1990 | O'Sullivan | 379/59 |
| 5,043,721 | 8/1991 | May | 340/825.44 |
| 5,095,307 | 3/1992 | Shimura et al. | 340/825.44 |
| 5,183,404 | 2/1993 | Aldous et al. | 439/55 |

OTHER PUBLICATIONS

"PC Card Standard", Release 2.0, published Sep., 1991 by Personal Computer Memory Card International Association of Sunnyvale, CA.

*Primary Examiner*—Donald J. Yusko
*Assistant Examiner*—Edward Merz
*Attorney, Agent, or Firm*—Kelly A. Gardner

[57] ABSTRACT

A method, in a data communication receiver, for selectively alerting a user at specified times, wherein the data communication receiver includes an interface for transmitting data to a host computer and an annunciator for generating a sensible alert, comprises the steps of receiving (505) an alarm message, wherein the alarm message comprises information indicating a time, and storing (505) the time. The method further comprises the steps of determining (510) an interface status as being coupled to the host computer or detached from the host computer and selectively activating (520) the annunciator at the time in response to determining (510) the interface status.

15 Claims, 5 Drawing Sheets

FIG. 3

PRIOR ART

| Pin | Signal | I/O | Function | +/- |
|---|---|---|---|---|
| 1 | GND | | Ground | |
| 2 | D3 | I/O | Data bit 3 | |
| 3 | D4 | I/O | Data bit 4 | |
| 4 | D5 | I/O | Data bit 5 | |
| 5 | D6 | I/O | Data bit 6 | |
| 6 | D7 | I/O | Data bit 7 | |
| 7 | CE1 | I | Card enable | - |
| 8 | A10 | I | Address bit 10 | |
| 9 | OE | I | Output enable | - |
| 10 | A11 | I | Address bit 11 | |
| 11 | A9 | I | Address bit 9 | |
| 12 | A8 | I | Address bit 8 | |
| 13 | A13 | I | Address bit 13 | |
| 14 | A14 | I | Address bit 14 | |
| 15 | WE/PGM | I | Write enable | - |
| 16 | RDY/BSY | O | Ready/Busy | +/- |
| 17 | Vcc | | Power Supply | |
| 18 | Vpp1 | | Programming and | |
| | | | Peripheral Supply | |
| 19 | A16 | I | Address bit 16 | |
| 20 | A15 | I | Address bit 15 | |
| 21 | A12 | I | Address bit 12 | |
| 22 | A7 | I | Address bit 7 | |
| 23 | A6 | I | Address bit 6 | |
| 24 | A5 | I | Address bit 5 | |
| 25 | A4 | I | Address bit 4 | |
| 26 | A3 | I | Address bit 3 | |
| 27 | A2 | I | Address bit 2 | |
| 28 | A1 | I | Address bit 1 | |
| 29 | A0 | I | Address bit 0 | |
| 30 | D0 | I/O | Data bit 0 | |
| 31 | D1 | I/O | Data bit 1 | |
| 32 | D2 | I/O | Data bit 2 | |
| 33 | WP | O | Write protect | + |
| 34 | GND | | Ground | |

FIG. 4

PRIOR ART

| Pin | Signal | I/O | Function | +/- |
|---|---|---|---|---|
| 35 | GND | | Ground | |
| 36 | CD1 | O | Card Detect | - |
| 37 | D11 | I/O | Data bit 11 | |
| 38 | D12 | I/O | Data bit 12 | |
| 39 | D13 | I/O | Data bit 13 | |
| 40 | D14 | I/O | Data bit 14 | |
| 41 | D15 | I/O | Data bit 15 | |
| 42 | CE2 | I | Card enable | - |
| 43 | RFSH | I | Refresh | |
| 44 | RFU | | Reserved | |
| 45 | RFU | | Reserved | |
| 46 | A17 | I | Address bit 17 | |
| 47 | A18 | I | Address bit 18 | |
| 48 | A19 | I | Address bit 19 | |
| 49 | A20 | I | Address bit 20 | |
| 50 | A21 | I | Address bit 21 | |
| 51 | Vcc | | Power Supply | |
| 52 | Vpp2 | | Programming and | |
| | | | Peripheral Supply 2 | |
| 53 | A22 | I | Address bit 22 | |
| 54 | A23 | I | Address bit 23 | |
| 55 | A24 | I | Address bit 24 | |
| 56 | A25 | I | Address bit 25 | |
| 57 | RFU | | Reserved | |
| 58 | RESET | I | Card Reset | + |
| 59 | WAIT | O | Extend bus cycle | - |
| 60 | RFU | | Reserved | |
| 61 | REG | I | Register select | - |
| 62 | BVD2 | O | Battery voltage detect 2 | |
| 63 | BVD1 | O | Battery voltage detect 1 | |
| 64 | D8 | I/O | Data bit 8 | |
| 65 | D9 | I/O | Data bit 9 | |
| 66 | D10 | I/O | Data bit 10 | |
| 67 | CD2 | O | Card detect | - |
| 68 | GND | | Ground | |

METHOD AND APPARATUS FOR RECEIVING AND SELECTIVELY ANNOUNCING TIME-ACTIVATED MESSAGES

This is a continuation of application Ser. No. 07/963,883, filed Oct. 19, 1992, now abandoned.

FIELD OF THE INVENTION

This invention relates in general to data communication receivers for receiving selective call messages, and more specifically to a data communication receiver for receiving and selectively announcing a time-activated selective call message.

BACKGROUND OF THE INVENTION

Conventionally, a data communication receiver, such as a pager, receives selective call messages for subsequent presentation to a user carrying the pager. A selective call message is originated when a message originator, i.e., a person desiring to send a selective call message, provides message information and a paging address associated with a pager to a paging terminal. The paging terminal thereafter encodes the paging address and the message information into a selective call message for radio frequency (RF) transmission within a geographic area. If located within the geographic area, the pager having the paging address receives the selective call message and decodes the message information contained therein, subsequent to which the reception of the selective call message is announced, perhaps by generation of an audible alert, to the user. The user may choose to view the message information upon reception or at a later time.

The message information may be, for example, a telephone number which the user must dial to contact the message originator. Thereafter, the message originator may convey important information to the user. If the pager has voice or alphanumeric capabilities, the message information may include a textual or voice message, thereby eliminating the need for the user to telephone the message originator. In this latter case, a message originator may send message information to which the user need not respond. A message originator may, for instance, send message information to a pager user simply informing the user of upcoming events, such as meetings or deadlines.

Upon reception of a selective call message containing this type of message information, the user may choose to make note of the time at which the upcoming event, such as a meeting or an appointment, occurs, especially if the message information is received a long time before the event is to take place. The user may, for example, mark the time of the event in a diary or a calendar. If the user has access to a personal computer, the time may be noted by entering it into an appointment book kept by the computer. Thereafter, at the time entered by the user, the computer may automatically generate an alert, such as an audible tone, to remind the user of the event.

However, noting the time of an event, such as a meeting, in a diary or computer does not necessarily guarantee that a pager user will remember the event. For instance, the user could accidentally note the time of the event incorrectly in his diary or simply forget to reference his diary. If he has entered the correct time in his computer, the automatic alert generated by the computer could occur during a time when the user is not located near the computer. Furthermore, if the user receives the selective call message including the time of the event when he is away from his diary or computer, he could forget to note the time of the event entirely. Therefore, manual entry of an event in a diary or a computer does not always ensure that the user will receive a reminder or remember the event.

Thus, what is needed is a data communication receiver which receives a selective call message including a reminder time for selectively alerting a user to remind him of an upcoming event. Furthermore, the data communication receiver should be able to transfer the reminder time to a host computer such that the host computer may thereafter automatically alert the user at the reminder time.

SUMMARY OF THE INVENTION

A data communication receiver includes an interface for transmitting data to a host computer and an annunciator for generating a sensible alert. A method in the data communication receiver for selectively alerting a user at specified times comprises the steps of receiving a message, wherein the message comprises at least information indicating a reminder time, storing the reminder time, and providing the message, including the reminder time, to the host computer. It is then determined that a real time is equivalent to the reminder time indicated by the message that has been provided to the host computer and whether the interface is coupled to or detached from the host computer. In response to determining that the interface is detached from the host computer when the real time is equivalent to the reminder time, the annunciator is activated.

An electronic device for selectively alerting a user at specified times and for coupling to an external host device includes a receiver for receiving and decoding a message to recover information contained therein, wherein the information comprises at least a reminder time. A memory stores the reminder time indicated by the message, and an interface transmits the message, including the reminder time, to the external host device when the interface is coupled to the external host device. Interface monitoring means coupled to the interface determines whether the interface is coupled to or detached from the external host device, a real time clock generates real time values, and determining means determines when a real time indicated by the real time values is equivalent to the reminder time irrespective of whether the message has been previously provided to the external host device. An annunciator generates a sensible alert, wherein the annunciator is activated by the interface monitoring means at the reminder time indicated by the message in response to the determination that the interface is detached from the external host device.

A data system for alerting a user at specified times includes a data communication receiver for receiving a message and recovering therefrom a reminder time and for selectively alerting the user at the reminder time indicated by the message irrespective of whether the message, including the reminder time, has been transmitted from the data communication receiver to another device. A host computer couples to the data communication receiver to receive the reminder time indicated by the message from the data communication receiver. The host computer automatically alerts the user at the reminder time indicated by the message.

BRIEF DESCRIPTION OF THE DRAWINGS

FIGS. 3 and 4 are charts depicting the pin assignments of the interface utilized by the data communication receiver of FIG. 1 in accordance with the preferred embodiment of the present invention.

DESCRIPTION OF A PREFERRED EMBODIMENT

Figure 1:
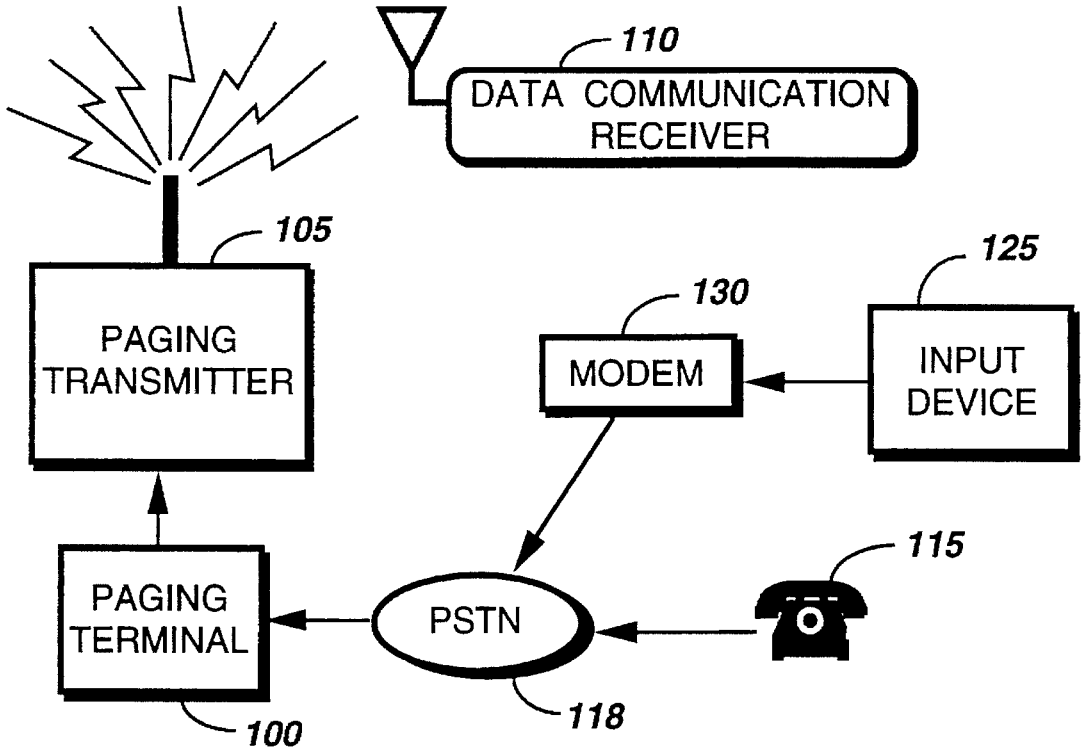
FIG. 1 depicts a selective call system in accordance with a preferred embodiment of the present invention.

Referring to FIG. 1, a selective call system, in accordance with a preferred embodiment of the present invention, comprises a paging terminal 100 which provides selective call signals to a paging transmitter 105 for transmission to at least one data communication receiver 110, e.g., pager. The selective call signals are selective call messages which have been encoded into a radio frequency (RF) signal by the paging terminal 100.

The information comprising the selective call messages is numeric or voice information received from a telephone 115 via a telephone network, such as the public switched telephone network 118 or a private branch exchange. Additionally, the information may be numeric or alphanumeric information received from another input device 125, e.g., a personal computer or electronic mail service, via a modem 130.

The information provided to the paging terminal 100 includes a paging address associated with the data communication receiver 110 and message information intended for reception by the data communication receiver 110. Preferably, if the message information is to be a reminder message to a user who carries the data communication receiver 110, the information provided to the paging terminal 100 further includes an alarm time at which the user is to be reminded of an upcoming event.

For instance, if a message originator, perhaps a coworker, desires to remind the user that a meeting is to be held at 3:00 p.m., the message originator provides the appropriate information to the paging terminal 100 via the telephone 115 or other input device 125. The information provided to the paging terminal 100 comprises at least the paging address of the data communication receiver 110 carried by the user and the message information to be presented to the user. If the message originator additionally wishes the data communication receiver 110 to provide a reminder alert to the user, the information further comprises an alarm time, such as 2:45 p.m. The paging terminal 100 encodes the information, comprising the paging address, the message information, and, if provided, the alarm time, into a known paging format for transmission from the paging transmitter 105.

The data communication receiver 110 thereafter receives the selective call signal and derives the message information and the alarm time contained therein. Preferably, reception of the message information is announced to the user, perhaps by generation of an audible tone. Additionally, in some cases, a reminder alert is generated by the data communication receiver 110 at the alarm time, i.e., 2:45 p.m., provided by the message originator, as will be described in greater detail below. In this manner, the user of the data communication receiver 110 is conveniently reminded of an upcoming event at a time specified by a message originator. Furthermore, the reminder alert may be automatically provided by the data communication receiver 110, thereby eliminating situations in which the user forgets to note the time in a diary or a calendar or forgets to reference a diary in which he has noted the time.

Figure 2:
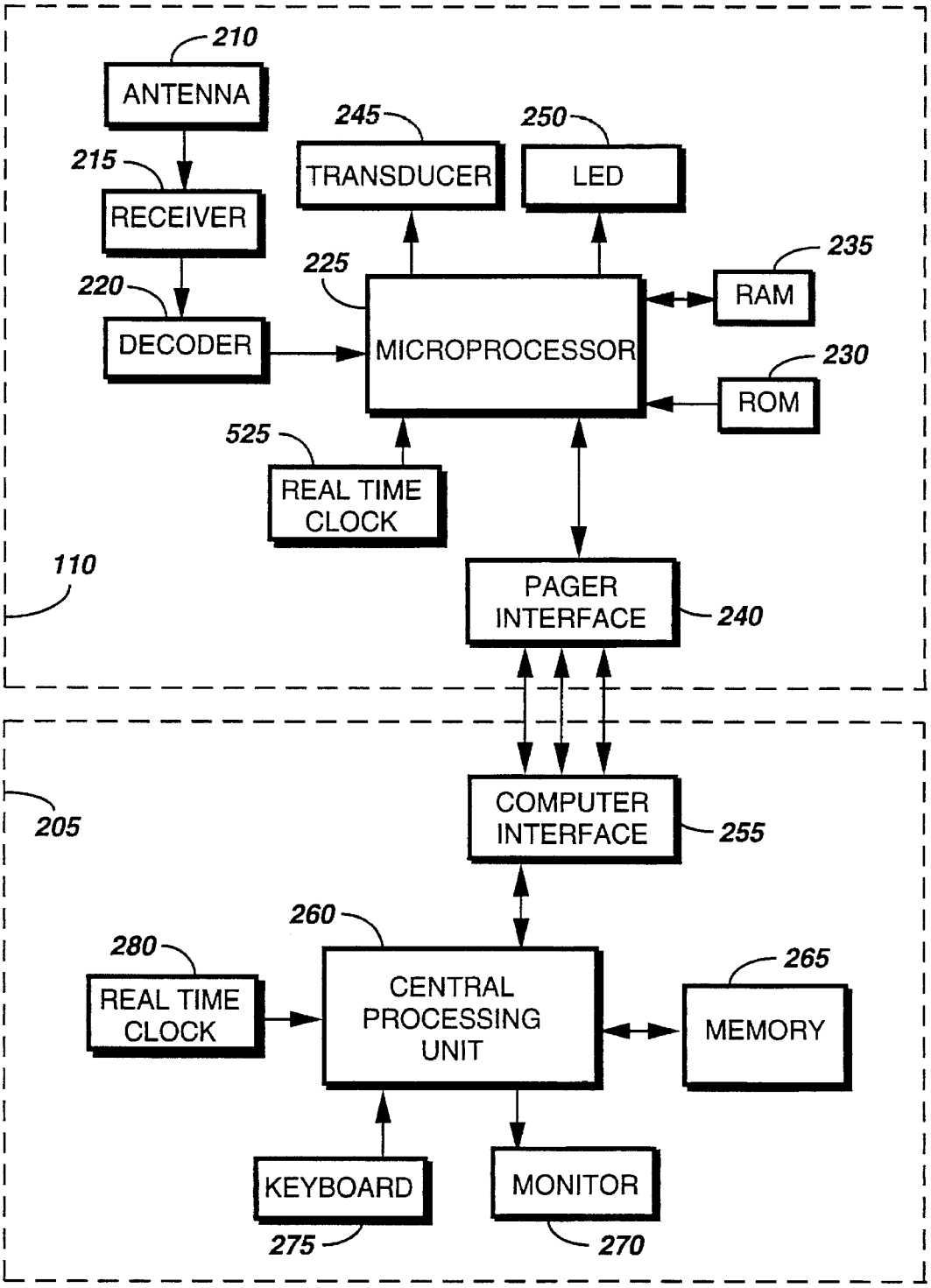
FIG. 2 is an electrical block diagram illustrating the interactive coupling of a host computer to the data communication receiver of FIG. 1 in accordance with the preferred embodiment of the present invention.

In accordance with the preferred embodiment of the present invention, the data communication receiver 110 may be coupled to a host computer, as may be better understood by referring to FIG. 2. FIG. 2 is an electrical block diagram of the data communication receiver 110 and of a host computer 205 to which the data communication receiver 110 may be interactively coupled. The data communication receiver 110 preferably comprises an antenna 210 for receiving an RF signal and a receiver 215 coupled to the antenna 210 for demodulating the RF signal. A decoder 220 coupled to the receiver 215 recovers an address and message information included within the RF signal. Additionally, the decoder 220 recovers time information, i.e., an alarm time, if present in the RF signal. The time information may be, for example, located as a block of header information preceding or following the message information. Alternatively, the time information may be recognized by the decoder 220 by predetermined delimiters which mark the location of the time information. The recovered address, message information, and alarm time are thereafter provided to a microprocessor 225, which compares the recovered address with addresses stored in a memory, such as a read only memory (ROM) 230. If the recovered address is equivalent to at least one of the stored addresses, indicating that the message information is intended for reception by the data communication receiver 110, the message information and the alarm time are stored in a random access memory (RAM) 235 coupled to the microprocessor 225.

In accordance with the preferred embodiment of the present invention, the data communication receiver 110 further comprises a pager interface 240 for coupling the data communication receiver 110 to the host computer 205. Preferably, the pager interface 240 is a standard 68-pin interface 240 defined in accordance with PCMCIA (Personal Computer Memory Card International Association) standards, although it may be appreciated that other types of interfaces, such as an RS-232 interface, may be utilized.

As shown in the charts depicted in FIGS. 3 and 4, the pager interface 240 includes a multiplicity of input/output (I/O) pins (pins 2–6, 30–32, 37–41, and 64–66) for transferring data between the data communication receiver 110 and the host computer 205. Additionally, a voltage is provided on a VCC pin (pin 17) of the pager interface 240 when the data communication receiver 110 is coupled to the host computer 205. In this manner, the data communication receiver 110 is able to monitor the VCC pin to detect the presence of the host computer 205.

Returning to FIG. 2, upon reception of the message information and the alarm time, the microprocessor 225 determines an interface status as being active, i.e., the data communication receiver 110 is coupled to the host computer 205, or inactive, i.e., the data communication receiver 110 is detached from the host computer 205. When the pager interface 240 is inactive, the microprocessor 225 activates a transducer 245 to generate an audible tone announcing reception of the message information. Alternatively, reception of the message information may be announced by a visible alert, such as light generated by a light emitting diode (LED) 250 or other light source.

When the microprocessor 225 determines that the data communication receiver 110 is coupled to the host computer 205, the message information and the alarm time are transferred to the pager interface 240 for subsequent transmission to a computer interface 255. According to the present invention, the computer interface 255 is also defined in accordance with PCMCIA standards. A central processing unit (CPU) 260 within the host computer 205 receives and stores the transmitted message information and alarm time in a memory 265. The CPU 260 then provides the message information to a monitor 270 for presentation to a user. The message may be presented automatically or in response to a command manually entered by the user into a computer keyboard 275.

Further coupled to the CPU 260 is a real time clock 280 for generating real time values. After reception of the message information and the alarm time, the CPU 260 continually monitors the real time values provided by the real time clock 280 and, when one of the real time values is equivalent to the alarm time, the CPU 260 provides a reminder signal to the monitor 270. In response to reception of the reminder signal, the monitor 270 presents a visible indication of the alarm time to the user. The indication may be, for example, an icon or a textual message indicating the time. Alternatively, the CPU 260 could activate an output device, such as a loudspeaker, such that an audible alert is provided to the user. It may be appreciated by one skilled in the art that the message information, indicating the time and type of upcoming event (meeting, appointment, deadline, etc.) may also be displayed on the monitor 270 at the alarm time. In this manner, the user is automatically reminded of an upcoming event by the host computer 205.

By way of example, a coworker could send to the data communication receiver 110 a message, including message information informing the user of an important appointment and an alarm time, perhaps ten minutes before the time of the appointment, at which the user should be reminded of the appointment. After coupling the data communication receiver 110 to the host computer 205, the user could read the message information, containing information about the appointment, on the monitor 270 of the host computer 205. Additionally, the host computer 205 could automatically store the message information, perhaps indicating the type and time of upcoming event, in an "appointment book" software application. Thereafter, at the alarm time, the host computer 205 would automatically generate an alert, such as a visible icon or audible tone, to remind the user of the appointment. As a result, the user does not have to manually note the time in an appointment calendar or enter the time in the computer to be reminded. Furthermore, because the alarm time is set by the message originator, situations are avoided in which the user incorrectly notes the time or does not note the time at all.

Although the host computer 205 automatically generates the reminder alert at the alarm time, a circumstance could arise in which the user is away from the host computer 205 when the reminder alert is generated and therefore remains unaware of the reminder alert. However, the data communication receiver 110 is intended for use both when coupled to and detached from the host computer 205, and, in accordance with the preferred embodiment of the present invention, the data communication receiver 110 also automatically generates a reminder alert at the alarm time when detached from the host computer 205. Therefore, the user is able to receive the reminder alert regardless of his location. It may be appreciated by one skilled in the art that, in alternate embodiments of the present invention, both the data communication receiver and the host computer could alert at the alarm time.

Figure 5:
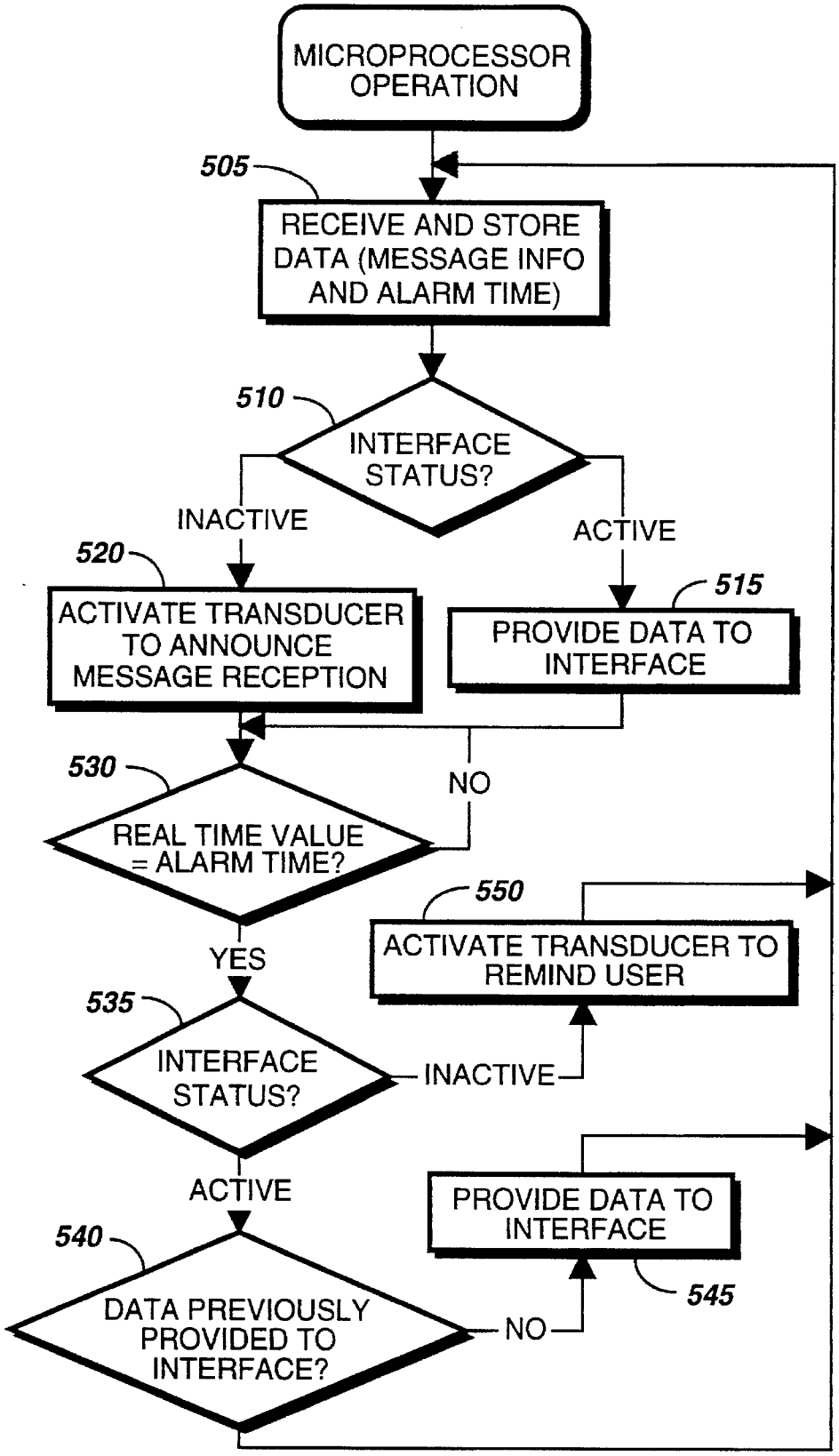
FIG. 5 is a flowchart illustrating the operation of the data communication receiver microprocessor upon reception of a time-activated message in accordance with the preferred embodiment of the present invention.

Referring next to FIG. 5, a flowchart depicts the operation of the microprocessor 225 (FIG. 2). As shown, in accordance with the preferred embodiment, the microprocessor 225, at step 505, receives and stores message information and an alarm time, subsequent to which the microprocessor 225 monitors the VCC pin of the pager interface 240 to determine, at step 510, the status of the pager interface 240. When the interface status is determined to be active, i.e., the data communication receiver 110 is coupled to the host computer 205, the message information and alarm time are provided, at step 515, to the I/O pins of the pager interface 240. The message information and the alarm time are thereafter transmitted to the host device 205, which presents the message information to the user. Additionally, at the alarm time, the host computer 205 automatically generates a reminder alert as described above.

When the pager interface 240 is determined to be inactive, i.e., the data communication receiver 110 is detached from the host computer 205, the microprocessor 225 activates, at step 520, the transducer 245, which thereafter generates an audible tone to announce reception of the message information. The user may then couple the data communication receiver 110 to the host computer 205 to read the message information.

Regardless of the interface status at the time of message reception, the microprocessor 225 continually monitors real time values provided by a real time clock 525 (FIG. 2) coupled to the microprocessor 225. While monitoring the real time values, however, the data communication receiver 110 continues to operate normally, i.e., further messages may be received, stored, and transmitted to the host computer 205. Additionally, the microprocessor 225 may simultaneously monitor the real time values until an alarm time specified in a different message occurs. When a real time value is determined, at step 530, to be equivalent to the alarm time, the microprocessor 225 again determines, at step 535, the interface status. When the pager interface 240 is determined to be active, the microprocessor 225 determines, at step 540, whether or not the message information and the alarm time have been previously transmitted to the host computer 205. If not, they are provided, at step 545, to the pager interface 240 for transmission to the host computer 205.

Alternatively, when the pager interface 240 is inactive at the alarm time, the microprocessor 225 activates, at step 550, the transducer 245 to generate a reminder alert to the user. Preferably, the reminder alert is generated at a different frequency than that of the alert utilized to announce reception of message information such that the two types of alerts may be readily differentiated by the user.

In summary, the data communication receiver in accordance with the preferred embodiment of the present invention is able to receive selective call messages comprising message information and an alarm time at which a user is to receive a reminder of an upcoming event. For example, if the user is to attend a meeting, a selective call message received by the data communication receiver may include an alarm time of ten or fifteen minutes before the meeting at which the user is to receive a reminder alert. This reminder alert may be generated by the data communication receiver or, alternatively, by a host computer to which the data communication receiver has transferred the alarm time. Therefore, the user is automatically reminded of an upcoming event without having to note the time of the event in an appointment book.

The data communication receiver not only may be interactively coupled to the host computer, but also may detect whether the data communication receiver is coupled to or detached from the host computer. Therefore, according to the present invention, the data communication receiver determines whether or not it is coupled to the host computer at the alarm time provided in the selective call message. If detached from the host computer, such as when the user is away from his office and carrying the data communication receiver, the data communication receiver independently generates the reminder alert. In this manner, the user may conveniently receive a reminder alert of an upcoming event even if he is away from his computer. Furthermore, since the reminder alert is determined by the originator of the selective call message, it is not necessary for the user to manually note the time of the event in order to receive the reminder alert.

It may be appreciated by now that there has been provided a data communication receiver which receives a selective call message including a reminder time for selectively alerting a user to remind him of an upcoming event. Furthermore, the data communication receiver should be able to transfer the reminder time to a host computer such that the host computer may thereafter automatically alert the user at the reminder time.

We claim:

1. A method, in a data communication receiver, for selectively alerting a user at specified times, wherein the data communication receiver includes an interface for transmitting data to a host computer and an annunciator for generating a sensible alert, the method comprising the steps of:

receiving a message, wherein the message comprises at least information indicating a reminder time;

storing the reminder time;

providing the message, including the reminder time, to the host computer:

determining, subsequent to the providing step, that a real time is equivalent to the reminder time indicated by the message that has been provided to the host computer;

determining, in response to determining that the real time is equivalent to the reminder time, whether the interface is coupled to or detached from the host computer; and activating the annunciator in response to determining that the interface is detached from the host computer when the real time is equivalent to the reminder time.

2. A method, in a data system, for alerting a user at specified times, the data system including a data communication receiver for receiving and storing messages, the data communication receiver having an interface for transmitting data and a first annunciator for generating a first sensible alert, wherein the data system further includes a host computer for receiving and storing the data transmitted by the data communication receiver, the host computer having a second annunciator for generating a second sensible alert, the method comprising, in the data communication receiver, the steps of:

receiving a message comprising information indicating a reminder time;

providing the message to the host computer;

continuing to operate on the message that has been provided to the host computer by determining when a real time is equivalent to the reminder time indicated by the message;

determining, in response to determining that the real time is equivalent to the reminder time, whether the interface is coupled to or detached from the host computer;

selectively activating the annunciator in response to the determining step when the real time is equivalent to the reminder time, wherein the selective activation step comprises the steps of:

not activating the first annunciator in response to determining that the interface is coupled to the host computer;

activating the first annunciator in response to determining that the interface is detached from the host computer.

3. The method in accordance with claim 2, further comprising, in the host computer, the steps of:

receiving, in response to the providing step, the message, including the reminder time indicated thereby;

storing the reminder time;

determining that the real time is equivalent to the reminder time; and activating the second annunciator in response to determining that the real time is equivalent to the reminder time.

4. An electronic device for selectively alerting a user at specified times and for coupling to an external host device, the electronic device comprising:

receiving means for receiving and decoding a message to recover information contained therein, wherein the information comprises at least a reminder time;

a memory coupled to the receiving means for storing the reminder time indicated by the message;

an interface coupled to the memory for transmitting the message, including the reminder time, to the external host device when the interface is coupled to the external host device;

interface monitoring means coupled to the interface for determining whether the interface is coupled to or detached from the external host device;

a real time clock coupled to the interface monitoring means for generating real time values;

determining means for determining when a real time indicated by the real time values is equivalent to the reminder time irrespective of whether the message has been previously provided to the external host device; and an annunciator coupled to the interface monitoring means and the determining means for generating a sensible alert, wherein the annunciator is activated by the interface monitoring means at the reminder time indicated by the message in response to the determination that the interface is detached from the external host device.

5. The electronic device in accordance with claim 4, wherein:

the annunciator is not activated at the reminder time indicated by the message in response to the determining means determining that the interface is coupled to the external host device.

6. The electronic device in accordance with claim 4, wherein the receiving means comprises:

an antenna for receiving a radio frequency (RF) signal;

a receiver coupled to the antenna for demodulating the RF signal; and a decoder coupled to the receiver for recovering message, including the reminder time, from the demodulated signal.

7. The electronic device in accordance with claim 4, wherein the annunciator is a transducer for generating an audible alert.

8. The electronic device in accordance with claim 4, wherein the annunciator is a light source for generating a visible alert.

9. A data system for alerting a user at specified times, comprising:

a data communication receiver for receiving a message and recovering therefrom a reminder time and for selectively alerting the user at the reminder time indicated by the message irrespective of whether the message, including the reminder time, has been transmitted from the data communication receiver to another device; and a host computer for coupling to the data communication receiver to receive the reminder time indicated by the message from the data communication receiver, wherein the host computer automatically alerts the user at the reminder time indicated by the message.

10. The data system in accordance with claim 9, wherein:

the data communication receiver alerts the user at the reminder time indicated by the message when the data communication receiver is not coupled to the host computer even when the message has been previously provided to the host computer; and the data communication receiver does not alert the user at the reminder time indicated by the message when the data communication receiver is coupled to the host computer.

11. The data system in accordance with claim 9, wherein the data communication receiver comprises:

receiving means for receiving and decoding the message to recover the reminder time;

a memory coupled to the receiving means for storing the reminder time indicated by the message;

an interface coupled to the memory for transmitting the reminder time to the host computer when coupled to the host computer;

interface monitoring means coupled to the interface for determining whether the interface is coupled to or detached from the host computer;

a real time clock coupled to the interface monitoring means for generating real time values; and an annunciator coupled to the interface monitoring means for generating a sensible alert, wherein the annunciator is activated at the reminder time indicated by the message in response to the determination that the interface is detached from the host computer.

12. The data communication receiver in accordance with claim 11, wherein:

the annunciator is not activated in response to the determination by the interface monitoring means that the interface is coupled to the host computer at the reminder time indicated by the message.

13. The data communication receiver in accordance with claim 11, wherein the interface is defined in accordance with PCMCIA (Personal Computer Memory Card International Association) standards.

14. The data communication receiver in accordance with claim 11, wherein the receiving means comprises:

an antenna for receiving a radio frequency (RF) signal;

a receiver coupled to the antenna for demodulating the RF signal; and a decoder coupled to the receiver for recovering the message, including the time, from the demodulated signal.

15. The data communication receiver in accordance with claim 11, wherein the annunciator is a transducer for generating an audible alert.

* * * * *